US006601990B2

(12) United States Patent
Shigeta et al.

(10) Patent No.: US 6,601,990 B2
(45) Date of Patent: Aug. 5, 2003

(54) PAPER BAG

(75) Inventors: Yoshiki Shigeta, Okegawa (JP); Yoshiki Shigeta, Yokohama (JP)

(73) Assignee: Showa Paxxs Corporation (JP)

( * ) Notice: Subject to any disclaimer, the term of this patent is extended or adjusted under 35 U.S.C. 154(b) by 0 days.

(21) Appl. No.: 10/105,659

(22) Filed: Mar. 25, 2002

(65) Prior Publication Data

US 2002/0141665 A1 Oct. 3, 2002

(30) Foreign Application Priority Data

Mar. 28, 2001 (JP) ..... 2001-091964

(51) Int. Cl.[7] ..... B65D 33/18

(52) U.S. Cl. ..... 383/84; 383/120; 383/202; 383/203; 383/211

(58) Field of Search ..... 383/78, 84, 210, 383/211, 203, 120, 202

(56) References Cited

U.S. PATENT DOCUMENTS 5,029,712 A * 7/1991 O'Brien et al. ..... 229/87.05
6,048,100 A * 4/2000 Thrall et al. ..... 383/86
6,120,184 A * 9/2000 Laurence et al. ..... 383/205
6,241,390 B1 * 6/2001 Schneck ..... 383/203
6,299,355 B1 * 10/2001 Schneck ..... 383/205
6,315,448 B1 * 11/2001 Thrall ..... 383/205
6,325,541 B1 * 12/2001 Thrall et al. ..... 383/203
6,328,472 B1 * 12/2001 Laurence et al. ..... 383/211
6,478,465 B1 * 11/2002 Thrall ..... 383/205

FOREIGN PATENT DOCUMENTS

CH 0618934 * 8/1980 ..... 383/85
EP 0400826 * 12/1990 ..... 383/211
GB 2 216 867 A * 10/1989 ..... 383/123

* cited by examiner

*Primary Examiner*—Jes F. Pascua
(74) *Attorney, Agent, or Firm*—Greer, Burns & Crain, Ltd.

(57) ABSTRACT

A paper bag is provided with a closure flap (14) such that a portion thereof protrudes from the opening edge (11*a*) of a paper bag body (11), that is opened to allow the removal of its content. The surface of the portion of the closure flap (14) that protrudes from the opening edge (11*a*) of the paper bag body (11) is coated with a non-water-soluble hot-melt adhesive (17). An underlining paper piece (20) is previously affixed, with a water-soluble adhesive (21), to the wall surface area where the closure flap (14) overlaps when it seals the opening of the paper bag by reactivating the hot-melt adhesive (17) on the surface of the closure flap (14), thus making it possible to peel this underlining paper piece (20) off from the wall surface (11*c*) of the paper bag body (11) together with a split part of the closure flap (14). This configuration makes it easy to remove all pieces of the paper bag to which the non-water-soluble adhesive is adhered before recycling process.

11 Claims, 4 Drawing Sheets

PAPER BAG

CROSS REFERENCE TO RELATED APPLICATIONS

This application is based upon and claims the benefit of priority from the prior Japanese Patent Application No. 2001-91964 filed on Mar. 28, 2001; the entire contents of this prior application being incorporated herein by reference.

BACKGROUND OF THE INVENTION

1. Field of Invention

The present invention relates to a paper bag, and more particularly to a paper bag that is improved so as to be easily processed during recycling when the paper bag is discarded after the content therein has been removed.

2. Description of the Related Art

Conventionally, a paper bag made primarily of craft paper and to be filled with, for example, animal feed, cement, grain, fertilizer or resin pellets (hereinafter termed, "content") for transport the content is sealed after filling with content, by folding back the opening edge and using a resin hot-melt adhesive to secure the folded back opening edge to the facing wall surface.

Specifically, in a paper bag with gussets on both sides that is made of craft paper and cut in steps, a resin hot-melt adhesive has been applied and dried on at least the stepped surface at an opening for filling with the content, so that, when this paper bag is used, a sealing device known as a "top sealer" is used to seal this opening after the content is filled through this opening.

The top sealer blows hot air against the hot-melt adhesive, which had been coated and then cooled onto the stepped surface in advance, thereby not only reactivating the hot-melt adhesive, but also folding the step-cut edge part at a specific location, fastening it to opposite wall surface using the reactivated hot-melt adhesive.

It should be noted that this type of hot-melt adhesive is dry and solid until it is used for sealing, preventing inadvertent adhesion. And merely by blowing the hot air against it, the hot-melt adhesive is easily and immediately reactivated to form an adhesive that has an extremely high adhesive strength and does not peel easily. Therefore, this type of hot-melt adhesive material is used broadly in this type of paper bags as an extremely convenient adhesive.

However, from the perspective of resource conservation, there have been increasing demands in recent years to recycle products, and this type of paper bag is not an exception. In order to prevent contamination, this type of paper bag is mostly not reused after it has been filled with content such as described above and used for transport, and thus this type of paper bag is normally subjected to incineration processes.

However, recent requirements for recycling resources have included plans to use recycled paper for these types of paper bags as well. However, the hot-melt adhesive that is used for sealing the content fill openings of these paper bags, has become an impediment to recycling. This is because the paper bags are to be dissolved in water when they are recycled after use.

On the other hand, the hot-melt adhesive used for sealing the content fill opening is kept to be adhered to the paper bag even after use of the bags. Generally, polymers, such as thermoplastic polymers, are used as the hot-melt adhesive, and when in use, the hot-melt adhesive is melted through the application of heat. Since the thermoplastic polymers used as the hot-melt adhesive do not dissolve in water, such hot-melt adhesive may get caught on the filters in the recycling process, which has been a problem in that it interferes with the recycling processes.

The above would be resolved by using a water-soluble adhesive such as polyvinyl alcohol as the hot-melt adhesive for sealing the content fill opening. However, when adhering a water-soluble adhesive, the evaporation of the water in the adhesive takes a long time. Therefore, such water-soluble adhesives are ill-suited as adhesive for use in sealing the paper bags after the content is fill therein.

Additionally, this type of water-soluble adhesive is vulnerable to water even after the adhesion has been effected, that is, after being hardened unless the adhesion is made completely secure over time. Thus, there is the danger of a serious problem in that the sealed part may be peeled off, causing the content to leak. This is likely to occur when the paper bag is stored for an extended period of time in a high-humidity location after it has been filled with content.

Although it is necessary to remove the hot-melt adhesive from the paper bag when recycling the paper bag after use, it is difficult to remove only the hot-melt adhesive from the paper bag. Therefore, workers have used knives, for example, to cut off the portion of the paper bag to which the hot-melt adhesive has been adhered, or have used cutting machines to cut off certain parts of the bag.

In recycling process for this type of paper bag, the part to which the hot-melt adhesive is adhered has been cut from the paper bag in this way to separate from a part to which there is no hot-melt adhesive adhered. And the part with no hot-melt adhesive has been dissolved in water. However, the considerable labor was involved in cutting off the part of the paper bag to which the hot-melt adhesive is adhered after use in order to separate the two. This has lead to problems with excessive costs in preparing this type of paper bag for the recycling process.

SUMMARY OF THE INVENTION

An object of the present invention is to provide a paper bag that is the solution to the conventional problems, a paper bag wherein it is possible to remove with ease, in the recycling process, the portion of the bag to which the hot-melt adhesive is adhered, even when using an extremely convenient non-water-soluble hot-melt adhesive, such as thermoplastic polymers, in sealing the content fill opening.

The paper bag of the present invention comprises a paper bag body, one end of which is closed with a closure flap that is equipped in a gusseted tubular trunk part such that a portion of the closure flap protrudes from an edge or edges of one end and/or another end of the trunk part, said closure flap closing said one end to form a bottom part of the bag, or closing said another end being used as an opening through which the paper bag body is filled with a content after the content is filled through the opening; a non-water-soluble hot-melt adhesive that is coated on a surface of said portion of said closure flap that protrudes from the edge of said paper bag body; and an underlining paper piece that is adhered in advance with a water-soluble adhesive to a part of one wall surface of said paper bag body that overlaps the closure flap when said closure flap is folded along with said end of the paper bag body and is adhered to said wall surface by reactivating said non-water-soluble hot-melt adhesive, wherein, said underlining paper piece can be peeled from said wall surface of said paper bag body or can be peeled away between layers of said underlining paper piece.

Additionally, the paper bag of the present invention comprises a paper bag body, which is closed at a bottom part and is opened at an opening; a closure flap equipped in said paper bag body so that a portion of the closure flap protrudes from an edge of said opening of said paper bag body through which content is removed from said paper bag body after said paper bag body is filled with the content; a non-water-soluble hot-melt adhesive that is coated on a surface of said portion of said closure flap that protrudes from the edge of the opening of said paper bag body; and an underlining paper piece that is adhered in advance with a water-soluble adhesive to a part of one wall surface of said paper bag body that overlaps the closure flap when said closure flap is folded along with said edge of the opening of the paper bag body end and is adhered to said wall surface by reactivating said non-water-soluble hot-melt adhesive, wherein, said underlining paper piece can be peeled from said wall surface of said paper bag body or can be peeled away between layers of said underlining paper piece.

Further, in the paper bag of the present invention, when the closure flap is torn in the cross-wise direction when opening the paper bag, the remaining pieces adhered with the hot-melt adhesive are adhered to the paper bag body with a water-soluble adhesive. Furthermore, in the paper bag of the present invention, the underlining paper piece adhered to the wall surface of the paper bag trunk unit is provided with a handle part across the entire end positioned at the edge of the wall surface side of the paper bag body, or provided with a grip part at a corner thereof. Still further, the closure flap is provided with an opening tape.

By doing the above, it becomes extremely easy to perform the operation when peeling the underlining paper piece from the wall surface of the paper bag body. The paper bag provided with the characteristics described above can also be applied to paper bags that are provided with folded parts (gussets) with V-shaped cross sections on both sides of the paper bag body. Additionally, in the paper bag of the present invention, it is preferable for the inside of the paper bag body to be equipped with an inner bag made from a material other than paper.

This inner bag can be made from, for example, a resin film, providing moisture resistance. The inner bag can also be fabricated from thin sheets of metallic material, providing this type of paper bag with anti-moisture properties and a gas barrier.

DESCRIPTION OF THE EMBODIMENTS

Embodiments of the present invention will now be described in detail referring to the accompanying drawings.

Figure 1:
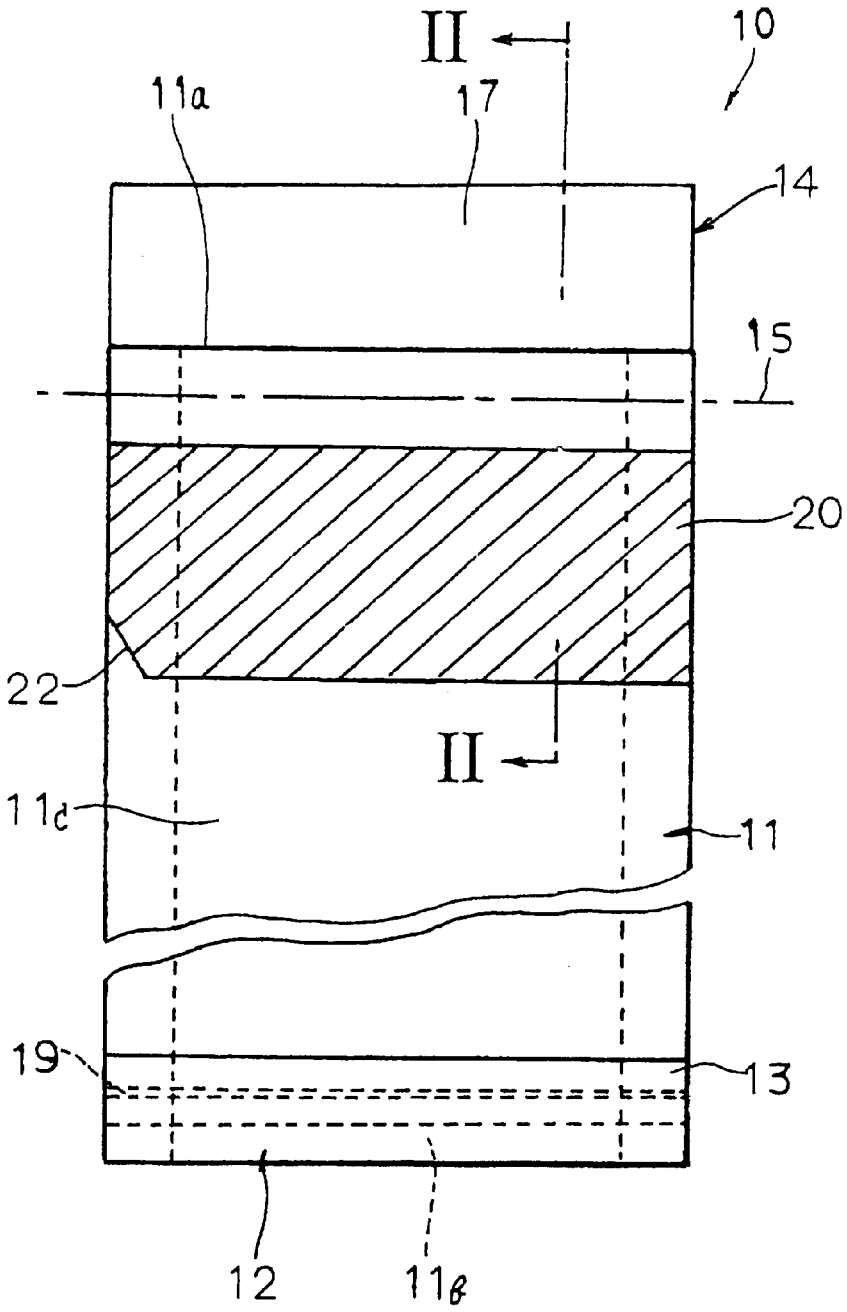
FIG. 1 is a schematic plan view of the flattened state of a paper bag according to an embodiment of the present invention.

FIG. 1 shows schematically a paper bag 10 according to one embodiment of the invention, in its flattened state. The paper bag 10 according to this embodiment is made, primarily, of craft paper, and provided with gusset wherein the bottom part is closed and the top part is open.

This paper bag body 11 is fabricated by having linear cuts at both ends, one end forming the opening for filling with content, and the other end being closed, following standard methods to form the bottom. The closed bottom part 12 is made by folding the opposite edge 11*b* of the paper bag body 11, enclosing this folded edge part of the paper bag body 11 in a contact paper 13 that spans the entire width thereof, and adhering both ends of the contact paper 13 by a water-soluble adhesive to the respective wall surfaces 11*c* and 11*d* of the paper bag body 11.

Since the closed bottom part 12 has been formed by paper bag manufacturers manufactured the paper bag 10, it can afford to spend some time for the evaporation of water even when the contact paper 13 is adhered using a water soluble adhesive exposing the paper bag to water vapor for several hours, or it is possible to apply a strong enough pressure thereto to create secure adhesion. Note that the inner surface of the contact paper 13, which is used to structure bottom closed part 12 of the paper bag body 11, is adhered with a strong resin sealing tape 19 across its entire width.

Figure 2:
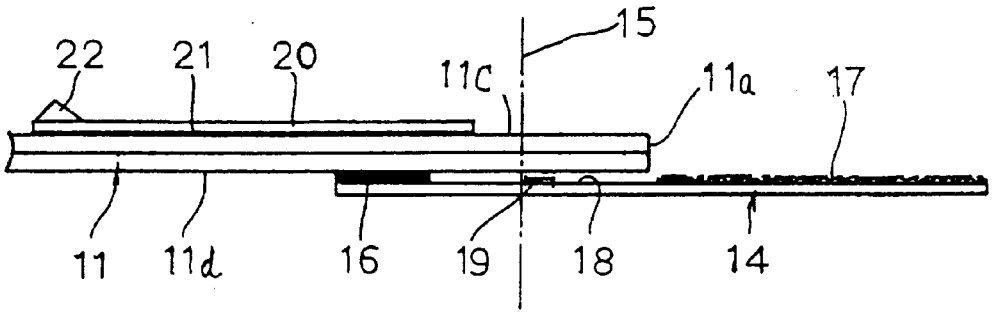
FIG. 2 is a schematic lengthwise cross-sectional view showing the structure of the opening of the paper bag of the embodiment viewed along the line II—II in FIG. 1.

On the other hand, one end part, or in other words, the opening end, of the paper bag body 11 is provided with a closure flap 14, as shown in FIG. 2, that extends in the outward direction from the opening edge 11*a* along the lengthwise direction of the paper bag body 11. One end of the closure flap 14 is adhered by a water-soluble adhesive 16 to a wall surface 11*d* at a position closer to the center in the lengthwise direction than the position where the fold line 15 passes, which is somewhat inside from the opening edge 11*a* of the paper bag unit 11.

An adhesive, such as a hot-melt adhesive 17, made from synthetic resin, such as a thermoplastic polymer, is coated onto the surface of the other edge part that extends from the opening edge 11*a* of the paper bag body 11 on the closure flap 14, and is caused to cool. This hot-melt adhesive 17 is a non-water soluble adhesive, and dries quickly, and has a particularly high adhesive strength. However, as described above, this material is not water-soluble.

In this type of closure flap 14, the adhesive material is not coated in the area between the part that is coated with the hot-melt adhesive 17 and the edge of the adhered part that is adhered by the water-soluble adhesive 16 to the wall surface 11*d* of the paper bag body 11, and as a result, this part is not adhered to the paper bag unit 11.

This part, or in other words, the part that not coated with an adhesive, is called the "non-adhered part" of the closure flap 14, and is shown by the reference number 18 in FIG. 2. A strong resin-reinforced opening tape 19 is attached across the entire width of the inner surface of this non-adhered part 18 of the closure flap 14.

On the other hand, in the region of the surface 11*c* of the paper bag body 11, which is overlapped directly with the other edge part of the closure flap 14 that extends from the opening edge 11*a* of the paper bag body 11 when the closure flap 14 is folded along a fold line 15 together with the opening edge 11*a* of the paper bag body 11, as well as in the region that is somewhat closer to the center of the paper bag body 11, an underlining paper (the underlining paper tape) 20 (the part shown by the shadow lines in FIG. 1 and FIG. 5) is adhered in advance across the entire width of the paper bag body 11.

Figure 5:
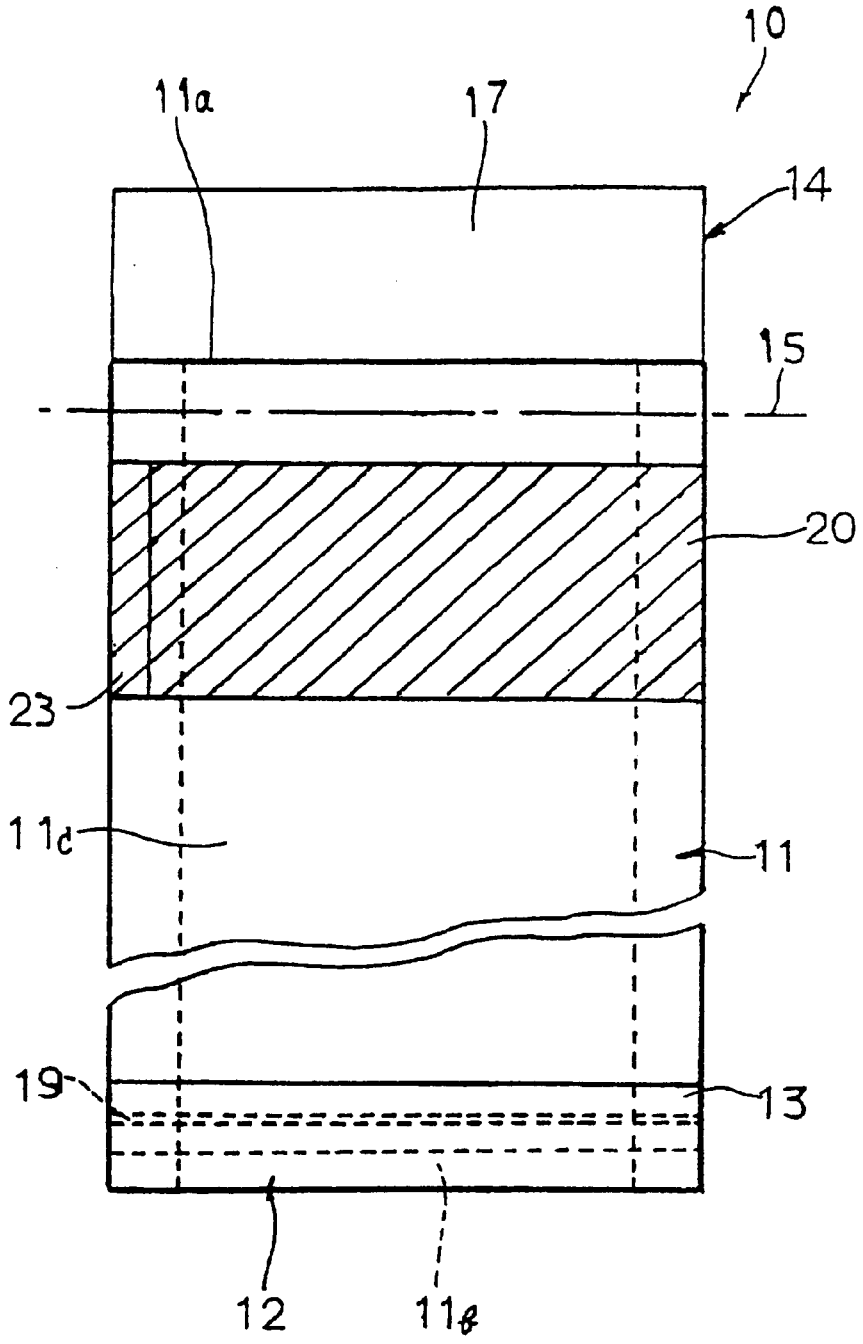
FIG. 5 is a schematic plan view of the flattened state of a paper bag according to another embodiment of the present invention.

This underlining paper tape 20 is adhered by a water-soluble adhesive 21, such as starch adhesive or polyvinyl alcohol, that can be peeled from the wall surface 11*c* of the paper bag body 11. As is shown in FIG. 5, a handle part 23 of the underlining paper tape 20, which is already peeled, is formed on the entire edge portion that is positioned at the side edge of the wall surface of the paper bag body 11. By fabricating this already-peeled handle part 23 over a broad area in this way, the underlining paper tape 20 can be peeled and removed with more certainty from the wall surface 11*c*, while the remaining part 14*b* of the closure flap 14 remains attached to the surface. Although the handle part 23 is provided on the left edge of the underlining paper tape 20 in the embodiment shown in FIG. 5, it is not limited thereto, and can be provided on the right edge or on both the left and right edges.

Instead of the already-peeled handle part 23, a grip part 22, which is already peeled, can be provided in the corner part of the underlining paper tape 20 closer to the center in the lengthwise direction, positioned on the side edge of the wall surface of the paper bag body 11 as shown in FIGS. 1–4.

This grip part 22 can be fabricated by making only a triangular-shape corner of the underlining paper tape 20 not being adhered to the wall surface 11*c* so that it rises freely from the surface, the corner being positioned closer to the center of the paper bag body 11 in the lengthwise direction. Of course, this part may also be fabricated by peeling it after adhesion.

Next, the use of the paper bag 10 according to this embodiment, as structured above, will be explained. Suppose that the opening end 11*a* of this paper bag 10 is open and a specific amount of content has been filled therein. Hot air is then blown against, and reactivates, the holt-melt adhesive 17 coated on the surface of an edge part of the closure flap 14 opposite to the edge part that is adhered to the wall surface 1 Id on one edge part of this paper bag 10.

Figure 3:
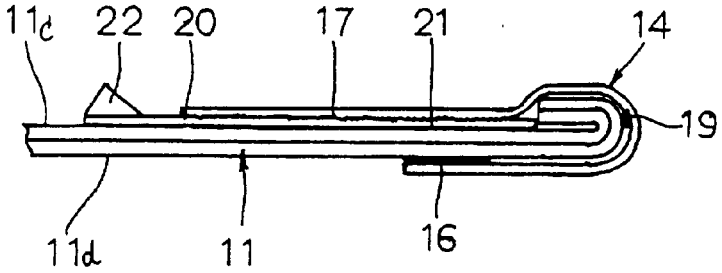
FIG. 3 is a schematic lengthwise cross-sectional view of the paper bag of the embodiment in FIG. 1, the same as FIG. 2, where the opening is folded back and sealed.

Then, the edge part of the paper bag 10 is then folded at the fold line 15. In other words, as is shown in FIG. 3, the closure flap 14 is folded along with the opening of the paper bag body 11 to lie against the wall surface 11*c* of the paper bag body 11. However, the hot-melt adhesive coating part of the closure flap 14 does not directly lie against the wall surface 11*c* of the paper bag body 11, but rather overlaps, and is in contact with, the surface of the underlining paper tape 20.

In other words, when the closure flap 14 is folded along with the opening of the paper bag body 11 at the fold line 15, the underlining paper tape 20 is affixed with a water-soluble adhesive 21 to the region of the wall surface 11*c* that is designed so as to overlap with the hot-melt adhesive coated part of the closure flap 14, and thus the hot-melt adhesive coated part of the closure flap 14 lies against, and is in contact with, the surface of this underlining paper tape 20.

The open end of the paper bag 10 according to this embodiment, is closed, or in other words, sealed, in this way. This sequence of sealing operations can use the sealing equipment called "top sealer" as has been used conventionally, as is described above. Furthermore, because the closure flap 14 uses the hot-melt adhesive that is a thermoplastic polymer, such as has been used in the past, it dries rapidly and has a greater adhesive strength, so it is possible to complete the seal on the opening of the paper bag 10 in a brief moment.

Now, the opening and the preparations for the recycling process of the paper bag 10 sealed as described above will be described. When opening the paper bag 10 which has been filled with content and which has been sealed on its top end, one end of the opening tape 19 is grasped and forcefully pulled up from the state shown in FIG. 3, tearing the closure flap 14 along a line in the crosswise direction.

Figure 4:
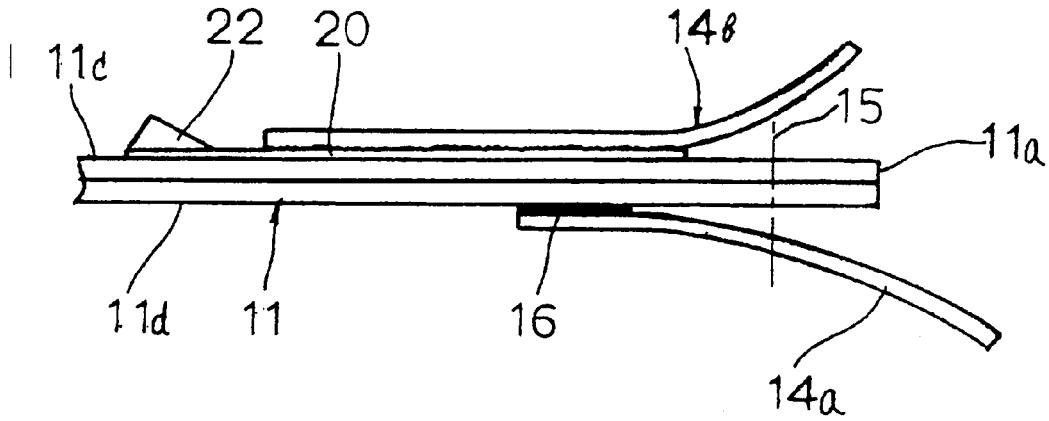
FIG. 4 schematic lengthwise cross-sectional view of the paper bag of the embodiment in FIG. 1, the same as FIG. 2, where the sealed paper bag opening shown in FIG. 3 is opened.

By doing this, the closure flap 14 is split into two pieces, as shown in FIG. 4: one is the remaining piece 14*a*, wherein the edge part thereof is adhered to the wall surface 11*d* of the paper bag body 11, and the other is remaining piece 14*b* wherein the edge part is adhered to the wall surface 11*c* of the paper bag body 11. As described above, since the portion between the adhered parts on the two edges of the closure flap 14 (between the adhered part on one side and the hot-melt adhesive coated part) is a non-adhered part 18, the opening of the paper bag body 11 is exposed between the remaining pieces 14*a* and 14*b* of the closure flap 14 when it is split in two, making it possible to remove the content.

The paper bag 10, after it has been used and after the content has been removed in this way, is then sent to the recycling process. At this time, the non-water soluble hot-melt adhesive material 17 that was used for affixing the closure flap 14 to the wall surface of the paper bag body 11 when filling the paper bag 10 as described above must be removed before the recycling process.

As is shown in FIG. 4, this holt-melt adhesive 17 exists on the adhesive part of the underlining paper tape 20 where the edge of the remaining piece 14*b* of the closure flap 14 is attached, and thus all the need be done is to remove each of the underlining paper tapes 20 from the wall surfaces 11*c* of the paper bag body 11.

Given the above, either the handle part 23, which is formed in the entire edge part of the underlining paper tape 20 which is exposed close to the center in the lengthwise direction of the paper bag body 11, or the grip part 22 that is formed on the corner part of one side, is grasped with the fingers and pulled up. When this is done, since the underlining paper tape 20 is adhered to the wall surface 11*c* of the paper bag body 11 using an easily peeled adhesive 21 such as paste, the peeling occurs at this location of adhesion, and the underlining paper tape 20 is peeled off from the wall surface 11*c* with the remaining piece 14*b* of the closure flap 14 still adhering to the surface.

By taking the above steps, the adhesives that remained on the wall surfaces 11*c* and 11*d* of the paper bag body 11 are all water soluble, so the paper bag body 11 can be completely dissolved in water after the underlining paper tape 20 is peeled off, with the results that even in the recycling process there will be no problems such as having occurred conventionally.

Although an explanation has been given regarding a closure flap 14 that is provided on one opening end of what is essentially a cylindrical shape of the paper bag 10 according to the embodiment of the present invention, the position in which the closure flap 14 is provided is not limited thereto, and it can be placed at the opening alone, at the bottom part alone, or at both the opening and the bottom part.

The same is applicable when the closure flap is provided in an end part of a cylindrical shape with gussets, and is folded along with the end part of the cylindrical shape to close the end part by adhering the closure flap to the wall surface on the bottom using the non-water-soluble adhesive that is provided on the closure flap, or when sealing is performed on the opening.

In the paper bag 10 according to the embodiment of the present invention described above, an example is given in which an opening tape is provided on the closure flap. However, the present invention is not limited to, but can be applied similarly in cases where no opening tape is provided. If there is no opening tape, then the paper bag of the present invention is opened using an opening tool such as a cutter knife or another cutting device.

Further, in the paper bag 10 in the embodiment of the present invention described above, an example was given of attaching an underlining paper tape 20 to the wall surface 11*c* of the paper bag body 11 using a water-soluble adhesive that can be peeled. However, similar effects can also be obtained through the use of an adhesive that, although it is water soluble, is difficult to peel, where the material properties of the underlining paper tape 20 are such that the underlining paper tape 20 itself separates between layers.

Furthermore, in the paper bag 10 according to the embodiment of the invention described above, the paper bag body 11 has gusset. However, the present invention is not limited thereto, but a paper bag body of any shape can be used. Also, the present invention can be applied similarly to anti-moisture bags wherein a polyethylene inner bag is inserted into the paper bag body 11 or to an anti-moisture/gas barrier paper bag wherein an inner paper bag of an aluminum foil sheet is inserted.

However, when it comes to this type of anti-moisture paper bag or anti-moisture/gas barrier paper bag, not only must the hot-melt adhesive be removed along with the underlining paper tape, as described above, but, of course, the inner bag must also be removed prior to forwarding to the recycling process. The removal of the inner bag from the paper bag body can be achieved easily by providing the specialized removal means that are already known conventionally.

As explained above, the paper bag of the present invention makes it possible to remove with ease prior to the recycling process, any parts to which hot-melt adhesive is adhering, even when using the extremely convenient non-water soluble hot-melt adhesive such as thermoplastic polymers in sealing the content fill opening.

What is claimed is:

1. A paper bag comprising:

a paper bag body, one end of which is closed with a closure flap that is equipped in a gusseted tubular trunk part such that a portion of the closure flap protrudes from an edge or edges of one end and/or another end of the trunk part, said closure flap closing said one end to form a bottom part of the bag, or closing said another end being used as an opening through which the paper bag body is filled with a content after the content is filled through the opening;

a non-water-soluble hot-melt adhesive that is coated on a surface of said portion of said closure flap that protrudes from the edge of said paper bag body; and an underlining paper piece that is adhered in advance with a water-soluble adhesive to a part of one wall surface of said paper bag body that overlaps the closure flap when said closure flap is folded along with said end of the paper bag body and is adhered to said wall surface by reactivating said non-water-soluble hot-melt adhesive, wherein, said underlining paper piece can be peeled from said wall surface of said paper bag body or can be peeled away between layers of said underlining paper piece.

2. A paper bag according to claim 1, wherein, when said paper bag is opened by cuffing said closure flap in the cross-wise direction with a cuffing means, a separated piece adhered with said hot-melt adhesive is adhered to said paper bag body with a water-soluble adhesive.

3. A paper bag according to claim 2, wherein said cutting means for separating said closure flap is an opening tape.

4. A paper bag according to claim 2, wherein said cutting means for separating said closure flap is a cutting knife or another type of cutting tools.

5. A paper bag according to claim 1, wherein the underlining paper piece adhered to the wall surface of said paper bag body is provided with a handle part that is already peeled off across entire end positioned at side edge of said wall surface of said paper bag body.

6. A paper bag according to claim 1, wherein the paper piece adhered to the wall surface of said paper bag body is provided with a grip part that is already peeled off at a corner positioned at side edge of said wall surface of said paper bag body.

7. A paper bag according to claim 1, wherein said paper bag is a gusseted paper bag equipped with gussets having V-shaped cross section on both sides of said paper bag body.

8. A paper bag according to claim 1, further comprising an inner bag made from a material other than paper equipped with the inside of said paper bag body.

9. A paper bag according to claim 8, wherein said inner bag is made of a resin film.

10. A paper bag according to claim 8, wherein said inner bag is made of a thin sheet of a metallic material.

11. A paper bag comprising;

a paper bag body, which is closed at a bottom part and is opened at an opening;

a closure flap equipped in said paper bag body so that a portion of the closure flap protrudes from an edge of said opening of said paper bag body through which content is removed from said paper bag body after said paper bag body is filled with the content;

a non-water-soluble hot-melt adhesive that is coated on a surface of said portion of said closure flap that protrudes from the edge of the opening of said paper bag body; and an underlining paper piece that is adhered in advance with a water-soluble adhesive to a part of one wall surface of said paper bag body that overlaps the closure flap when said closure flap is folded along with said edge of the opening of the paper bag body end and is adhered to said wall surface by reactivating said non-water-soluble hot-melt adhesive, wherein, said underlining paper piece can be peeled from said wall surface of said paper bag body or can be peeled away between layers of said underlining paper piece.

* * * * *